United States Patent [19]

Schechter

[11] 4,097,067

[45] * Jun. 27, 1978

[54] PRINTED COUPON FOLDER

[76] Inventor: Sheldon Schechter, 34 Bush Pkwy., East Brunswick, N.J. 08816

[ * ] Notice: The portion of the term of this patent subsequent to Mar. 8, 1994, has been disclaimed.

[21] Appl. No.: 756,077

[22] Filed: Jan. 3, 1977

Related U.S. Application Data

[63] Continuation-in-part of Ser. No. 626,629, Oct. 29, 1975, Pat. No. 4,010,964.

[51] Int. Cl.[2] ..... B42D 15/04

[52] U.S. Cl. ..... 283/56; 229/70; 283/62

[58] Field of Search ..... 283/34, 35, 56, 62; 281/5

[56] References Cited

U.S. PATENT DOCUMENTS

| | | | |
|---|---|---|---|
| 1,861,459 | 6/1932 | Smith | 281/5 X |
| 3,211,470 | 10/1965 | Wilson | 283/56 X |
| 3,259,304 | 7/1966 | Tichnor | 283/56 X |
| 3,334,806 | 8/1967 | Hiersteiner | 283/56 X |
| 3,718,277 | 2/1973 | Volkert | 283/56 X |
| 4,010,964 | 3/1977 | Schechter | 283/56 |

*Primary Examiner*—Harland S. Skogquist
*Attorney, Agent, or Firm*—Kirschstein, Kirschstein, Ottinger & Cobrin

[57] ABSTRACT

A direct mail coupon print promotional vehicle for the stimulation of retail sales of items by the distribution of printed cash discount coupons, which are presented by the consumer or customer at the time of purchase of the item. The vehicle is a direct mail printed coupon folder characterized by a plurality of rectangular paper panels on which the discount coupons are individually printed. The panels are attached end-to-end seriatim to form a rectangular element. A weakened zone such as scoring or perforations is provided between adjacent panels. Each weakened zone is linear and perpendicular to the long axis of the rectangular element, which latter is folded by a plurality of parallel over-and-over folds at said zones to the configuration of a single panel the thickness of which is the conjoint thickness of all of the panels, thus forming the coupon folder. Means is provided to secure the coupon folder against premature opening.

8 Claims, 9 Drawing Figures

PRINTED COUPON FOLDER

CROSS-REFERENCE TO RELATED APPLICATION

The present case is a continuation-in-part of U.S. patent application Ser. No. 626,629 filed Oct. 29, 1975, now U.S. Pat. No. 4,010,964 issued Mar. 8, 1977.

BACKGROUND OF THE INVENTION

1. Field of the Invention

The invention relates to a coupon print promotional vehicle for the stimulation of retail sales by mail distribution of printed redemption or cash discount coupons.

2. Description of the Prior Art

Printed cash discount coupons for the improvement of retail sales of items require inexpensive distribution vehicles because of the large volume of coupons which must be distributed in order to attain a viable improvement in retail sales. The ubiquitous consumer can only be reached in volume with these coupons through the use of inexpensive mass distribution media, since otherwise the cost of distribution of the coupons becomes prohibitive relative to the sales improvement accomplished. Thus, small incremental improvements in the cost of the distribution package results in impressive overall cost savings, because of the enormous volume of coupons distributed annually to potential consumers in this country, which basically is a consumer-oriented society.

A high average coupon redemption rate, typically up to 11%, has been attained in the prior art via direct mail insertion, in which a group of coupons together with associated descriptive and sales material is inserted in an envelope for direct mailing to the consumer. Each coupon is generally part or all of an individual paper panel, and a group of discrete individual panels is mailed as a unitary package. The panels are not connected to each other in any way in the package, but are merely jointly inserted in an envelope. When the consumer receives the package via direct mail, each panel must be separately perused. The panels generally contain, in addition to the coupons per se, printed messages describing the items, and/or illustrations of the items such as graphic arts illustrations, photographs, etc., together with sales promotional material. This prior art method of distributing cash discount or redemption coupons has proven to be quite practical and successful; however, the cost of preparing the package for direct mailing is quite high since the individual coupons must be collated and the package individually assembled. The envelopes must be closed, sealed, addressed and stamped. A typical cost per thousand coupons distributed via this method is on the order of $13.50, and when it is considered that these coupons are distributed by the millions, it is apparent that substantial distribution costs due to labor, handling, etc., are encountered by the direct mail insertion method of redemption or cash discount coupon distribution.

Other prior art media for coupon distribution include magazine pop-up inserts, in which a paper or paperboard insert is bound into a magazine so that when the magazine is read, the reader upon turning the pages will be confronted with the pop-up insert upon reaching a certain or specific page. This method of distributing redemption or cash discount coupons generally has a lower average redemption rate than direct mail insert, however magazine pop-ups have attained a degree of success since the cost per thousand coupons distributed is generally lower than with direct mail insertion. In addition, direct mail insert is subject to constantly increasing cost pressures since mailing rates for this type of distribution are generally increasing and are expected to further escalate in the future. A typical cost per thousand pop-up coupons is about $9.00.

Another form of prior art coupon distribution media is the printing of coupons directly on the pages of a magazine or newspaper. This requires the consumer to use a scissors to cut out the coupon for redemption and also necessitates mutilation of the page and loss by the consumer of whatever may be printed on the backside of the coupon. Thus in many instances the consumer may be reluctant to cut out the coupon, especially in the case of magazines which the consumer may wish to retain, e.g., in instances where an article of interest is at least partially printed on the backside of the coupon. The per thousand cost of such coupons is about $6.50.

Finally, another media for distributing coupons is free standing inserts, which are generally placed in newspapers, especially Sunday editions. These free standing inserts are subject to the same objections as is encountered with on-page printing in magazines or newspapers, namely that in practice the average redemption rate is very low, typically on the order of 3 to 5%, so that even though the cost per thousand to distribute the coupons is low, about $5.55, it has been established in the art that the actual cost per coupon redeemed is quite high.

A better evaluation of coupon costs is the cost per coupon redeemed. By this measure the per coupon cost of direct mail insertion is about 12 cents, of pop-up about 10 cents, of free standing inserts about 10 cents, and of on page coupon about 12 to 18 cents.

Accordion-type folders are commonly encountered for sale in tourist areas. These folders feature pictures and views of the tourist attraction, generally together with the title and description of the attraction.

SUMMARY OF THE INVENTION

1. Purposes of the Invention

It is an object of the present invention to provide an improved direct mail coupon print promotional vehicle.

Another object is to provide an improved printed coupon folder of the character described which facilitates the distribution of printed redemption or cash discount coupons to the consumer.

A further object is to provide an improved article of manufacture for distribution of redemption or cash discount coupons.

Still another object is to provide an improved article of manufacture for direct mailing of redemption or cash discount coupons.

These and other objects and advantages of the present invention will become evident from the description which follows.

2. Brief Description of the Invention

In the present invention, an improved medium for distribution of redemption or cash discount coupons is provided, which essentially consists of a coupon print promotional vehicle for direct mailing. The vehicle consists of a printed coupon folder constituting a plurality of oblong panels. Each panel is fabricated of paper, e.g., glossy finish paper, paperboard, or the like. Printing is included on the front and usually also on the back side of each panel. The printing on the front sides of the panels is most important, since this printing which includes the coupon per se is germane to the result to be accomplished, i.e., the redeeming of a redemption or cash discount coupon by an ultimate consumer via retail sales. The panels also include printing for sales promotion and/or the stimulation of retail sales of saleable items.

The term "saleable item" will be understood to encompass and include a broad range and variety of items, and includes essentially all items and articles of retail sales. A virtual plethora of different things may be promoted via the present printed coupon folder. Among the abundance of retail sales items contemplated as being within the ambit of the present invention is a foodstuff, soap, detergent, toothpaste, cigarettes, paper products such as bathroom tissue or waxed paper or other wrapping materials, dog or cat food, desserts, beverages, etc. A variety of implements such as eating utensils or a tool for the kitchen could also be featured as the saleable item. Thus, a broad variety of saleable items, especially retail sales items generally sold in supermarkets, could be the item being promoted via a redemption or cash discount coupon. Hence, the term "saleable item" includes any and all retail sales items, articles for the home and office, etc.

The present printed redemption coupon folder is characterized by the arrangement of the oblong panels seriatim, with the panels being attached end-to-end preferably at their long edges via individual weakened zones which are perpendicular to the long axis of the single elongated rectangular element formed by all of the attached panels taken together and viewed as a single unitary whole element. In actuality, the single elongated rectangular element would be the starting point for the manufacture of the folder, which is composed of paper, typically glossy or high gloss paper; paperboard, etc. The single element is readily folded about the weakened zones which may be formed via an integral fold, or by scoring, perforating or otherwise intermittently penetrating the surface of the element with a die or the like. An aspect of the present invention is the sequence of folding the unitary element which is accomplished by parallel over-and-over folding rather than accordion folding, so that the package when received by the ultimate consumer is readily opened to a flat strip of panels rather than a corrugated strip as is the case with accordion folding. Thus, all of the panels are instantly visible to the eye.

The present printed coupon folder possesses several salient advantages. An important advantage is economy of production and preparation for mailing distribution, as compared to direct mail insert, since the present invention sharply reduces labor costs for handling and collating because the panels are all printed on a single element. Another advantage is high average coupon redemption rate, estimated as about 6 cents per coupon redeemed, which is attained not only because of direct mailing but also because when the folder is received by the ultimate consumer, it is readily opened to full length due to the end-to-end folding, as will appear infra. A further advantage is that mis-redemption is greatly reduced compared to other methods of coupon distribution, since the coupons are received directly by the ultimate consumer through the mails as a unitary strip of coupons, which coupons and associated descriptive printed material are all immediately accessible to the consumer and all visible to the eye seriatim since the folder, when opened, lays or hangs flat because of the sequence of parallel over-and-over folding in the present invention. This reduction in mis-redemption, or diversion of the coupons to other products or other consumers, is specially important in supermarket retail sales. In a preferred embodiment, grids or lines are printed on the panel, which grids correspond to the universal product code or UPC for the particular retail sales item being promoted, so that the coupon can only be redeemed via purchase of the particular item, at the point of purchase, when a reader or scanner is provided as will be common in supermarkets in the near future. Thus, the UPC lines correlate the product to the coupon.

BRIEF DESCRIPTION OF THE DRAWINGS

Referring now to the drawings.

DETAILED DESCRIPTION OF THE PREFERRED EMBODIMENTS

Figure 1:
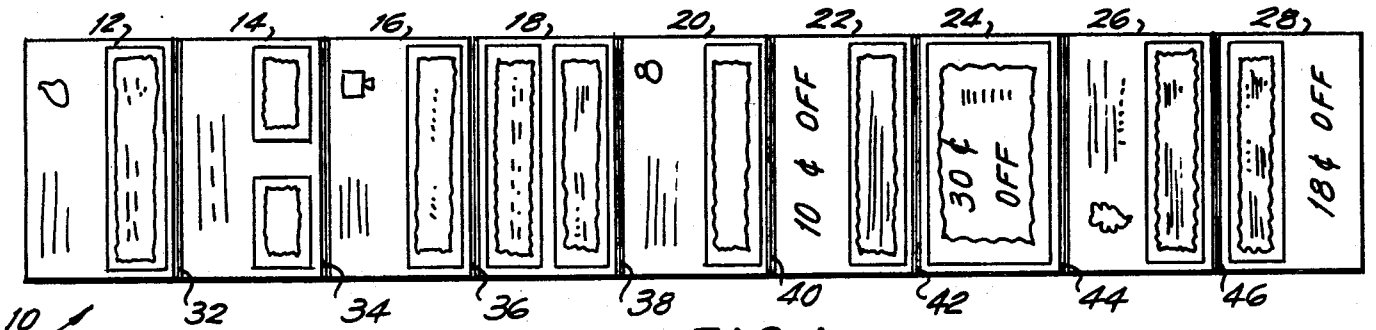
FIG. 1 is an overall plan view of a printed coupon folder of the present invention as it appears before folding.

Referring now to FIG. 1, an overall coupon print promotional vehicle 10 is shown prior to folding, and as the vehicle will be seen by the prospective ultimate consumer or customer after receipt, opening and unfolding of the vehicle. The vehicle 10 is composed of nine individual panels 12, 14, 16, 18, 20, 22, 24, 26 and 28. The panels are oblong and are attached long edge to long edge seriatim to form the unitary rectangular elongated element 10. The panels are made of paper, paperboard, or the like. The long axis of each panel, which long axis is preferably about 6⅛ inch in length, is disposed perpendicularly to the long axis of the unitary element 10. The short axis of each panel thus is coaxial with the long axis of the element 10. The short axis of each panel is preferably on the order of 5⅛ inch in length, to yield an overall length for the long axis of the element 10 in the range of from about 46.5 to about 47.0 inches.

A rectilinear weakened zone is provided between each pair of adjacent panels. Thus a zone 32 connects panels 12 and 14; a zone 34 connects panels 14 and 16; a zone 36 connects panels 16 and 18; a zone 38 connects panels 18 and 20; a zone 40 connects panels 20 and 22; a zone 42 connects panels 22 and 24; a zone 44 connects panels 24 and 26; and a zone 46 connects panels 26 and 28.

Each weakened zone is perpendicular to the long axis of the element 10, and the zone may be weakened in any well known manner as by creasing, scoring or perforating the paper or the like of which the element 10 is composed.

Each of the panels bears printed display symbols and at least one printed redemption coupon, however, in practice, the coupon may be omitted from one or more of the panels depending on client preference. The printed coupons provide tokens for the purchase of a saleable item at a fixed reduction in price, as indicated. The printed display symbols generally include a printed message describing the saleable item and/or an illustration of the saleable item, which illustration may be a photograph or a graphic arts illustration or interpretation of the saleable item, and/or promotional material to induce sales. A preferable total number of panels is nine as shown, however, other total numbers of panels such as seven or eleven may be adopted in practice.

Figure 2:
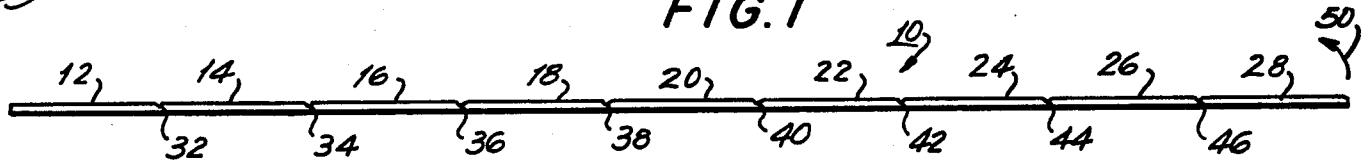
FIG. 2 is an elevation edge view of the folder of FIG. 1, with the thickness of the folder being exaggerated for purposes of clarity in elucidating the invention.

Referring now to FIG. 2, the long edge to long edge attachment of the panels to form the overall element 10 is apparent. The thickness of the panels has been exaggerated in this figure for the purpose of exposition. In most instances the panels will be no thicker than an ordinary sheet of high gloss paper or light weight paperboard of post card quality. The direction of the parallel edge-to-edge folding contemplated in the present invention is indicated by the curved arrow 50.

Figure 3:
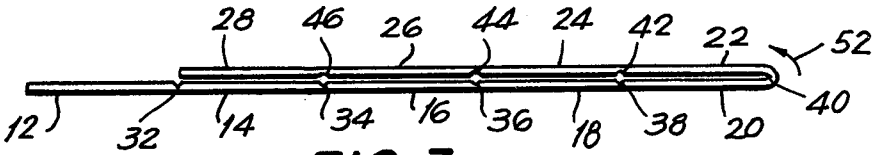
FIG. 3 is an elevation edge view of the folder after the first fold is made.

FIG. 3 shows the element 10 after the first parallel long edge to long edge fold which is about the central weakened zone 40, so that the length of the element 10 as folded has been reduced to four panels (doubled) plus one end panel 12, or about 25.5 inches, and the thickness has been doubled, except for the endmost panel 12. The panels are displaced as shown, with one endmost panel 28 now opposite to the panel 14, the panel 26 now opposite to the panel 16, the panel 24 now opposite to the panel 18, and the panel 22 now opposite to the panel 20. The curved arrow 52 indicates the direction of the next parallel long edge to long edge fold, which is in essence a sequence of folding in which the previously folded endmost fold is brought to the opposite end of the element 10 or adjacent thereto, as will appear infra, so that the panels of the element 10 are disposed in planar parallelism.

Figure 4:
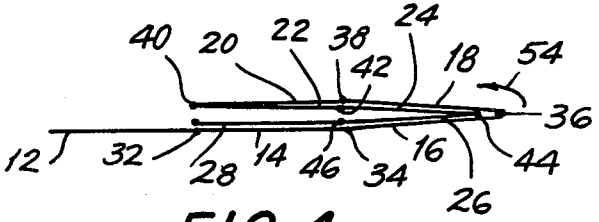
FIGS. 4, 5 and 6 are views similar to FIG. 3 but showing the folder in elevation view after successive folds are made, with the final printed coupon folder illustrated in FIG. 6 with integral sealing means attached; in this last group of figures all thicknesses are reduced to single lines for clarity of illustrations.

FIG. 4 illustrates the next parallel long edge to long edge fold about overlying registered weakened zones 36 and 44, accomplished by displacement as indicated supra via arrow 52. It is to be noted that since in FIG. 3 the total number of superposed panels is four, an even number, it is possible to fold along a pair of central opposed weakened zones so as to match the previously formed fold at zone 40 with the opposite end of the once folded element, thus zone 40 is displaced to a position in FIG. 4 above zone 32.

Figure 5:
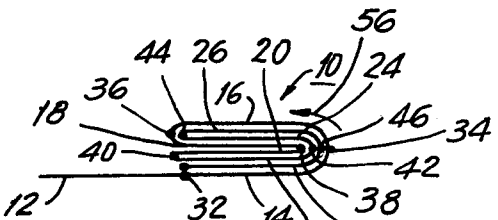

A curved arrow 54 shows the direction of the next parallel long edge to long edge fold, which accomplishes the result shown in FIG. 5, namely a fold about registered weakened zones 34, 46, 42, and 38.

Figure 6:
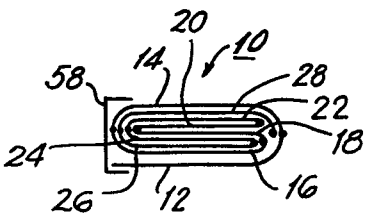

The final fold is about registered weakened zones 32 and 48 as shown by curved arrow 56, and results in the production of the FIG. 6 arrangement, in which all the panels are stacked in planar parallelism so that the printed coupon folder is formed with a thickness of nine panels. A sealing element 58 which may be a tab, tape or the like extends over the open end of the folder 10 between the panels 14 and 12. The opposite end of the folder 10 is of course secured by weakened zone 32 so that the folder 10 is now suitable for direct mailing.

Alternatively, glue spots or glue carrying tabs (tipping) may be provided on the element 10 to adhesively secure, after complete folding, the panel 12 to the panel 16 and the panel 16 to the panel 26, etc. The heights of the stacked panels in the partially folded positions and the fully folded positions of the element 10 are exaggerated due to the inability to illustrate the same to scale; hence some panels in these figures have been shown as larger than others — a condition which does not exist in the actual element.

It will be observed that the over and over folding employed tends to keep the combined height of the stacked panels to a minimum and thus facilitates the creation of a compact mailing folder.

Figure 7:
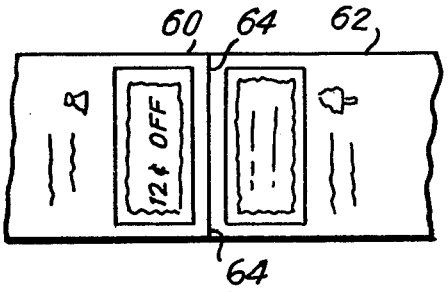
FIG. 7 shows a weakened zone formed by scoring between successive panels.

FIG. 7 illustrates two adjacent panels 60 and 62 connected by a weakened zone consisting of scoring 64.

Figure 8:
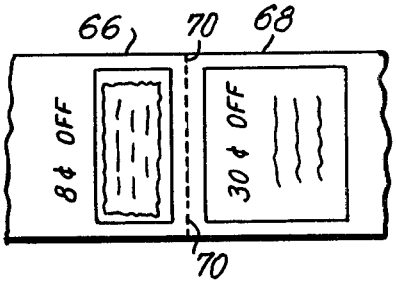
FIG. 8 shows a weakened zone formed by perforations between successive panels.

FIG. 8 shows two adjacent panels 66 and 68 connected by a weakened zone consisting of slit perforations 70.

Figure 9:
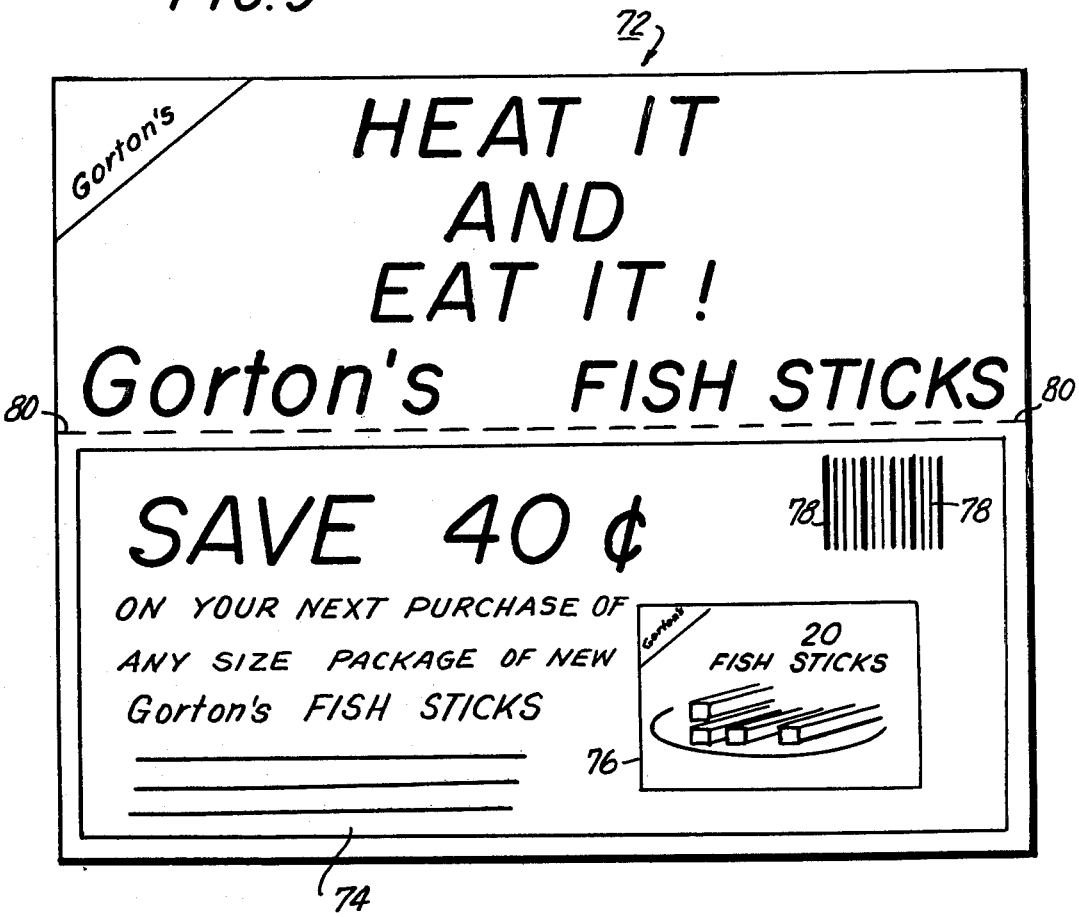
FIG. 9 is plan view of a typical panel with a coupon the size of a U.S. dollar bill.

Referring now to FIG. 9, a typical full scale panel 72 is shown. The coupon 74 may be the size of a U.S. dollar bill. Display symbols consisting of promotional material, a trademark for fish sticks, etc., are shown on the body of the panel exclusive of the coupon. The coupon 74 per se shows the cash discount available when the redemption coupon is submitted with purchase of the item, a graphic arts illustration 76 of a typical fish sticks package, and typical universal product code lines 78 which perform the function described supra, namely to guarantee that the coupon will be redeemable only for the specific saleable item being promoted, when the item plus coupon are subject to checking by a reader or scanner in a supermarket. This sharply reduces misredemption and correlates the product to the coupon. The panel 72 is preferably provided with a weakened zone 80, which in this instance is scoring, to facilitate the tearing of the coupon 74 from the balance of the panel 72.

Examples of the preparation of typical coupon print folders in accordance with the present invention will now be described:

EXAMPLE I

9 — $5\frac{1}{8} \times 6\frac{1}{8}$ inch panels equals $6\frac{1}{8} \times 46\frac{3}{4}$ inch (includes $\frac{5}{8}$ inch for folds and glue tipping areas):
Four folds to $5\frac{1}{8} \times 6\frac{1}{8}$ inch self mailer.

EXAMPLE II

7 — $5\frac{1}{8} \times 6\frac{1}{8}$ inch panels equals $6\frac{1}{8} \times 36\frac{3}{8}0$ inch (includes $\frac{1}{2}$ inch for folds and glue tipping areas);
Four folds to $5\frac{1}{8} \times 6\frac{1}{8}$ inch self mailer

EXAMPLE III

11 — $5\frac{1}{8} \times 6\frac{1}{8}$ inch panels equals $6\frac{1}{8} \times 57\frac{1}{4}$ inch (includes $\frac{7}{8}$ inch for folds and glue tipping areas);
Five folds to $5\frac{1}{8} \times 6\frac{1}{8}$ inch mailer.

It thus will be seen that the present invention is directed to parallel over-and-over folding where an odd number of panels is present, so that a single end panel after the first folding is not in registration with another panel. Thereafter, parallel over-and-over folding is practiced, with the final folding being of all the folded panels (excluding the single end panel) being folded over onto the single end panel.

It thus will be seen that there is provided a printed coupon folder which achieves the various objects of the invention and which is well adapted to meet the conditions of practical use.

As various possible embodiments might be made of the above invention, and as various changes might be made in the embodiment above set forth, it is to be understood that all matter herein described or shown in the accompanying drawings is to be interpreted as illustrative and not in a limiting sense.

Having thus described the invention, there is claimed as new and desired to be secured by Letters Patent:

1. A printed coupon direct mail folder comprising an odd numbered plurality of individual panels that are oblong in plan and equal in size and are attached edge to edge seriatim with their narrow sides in alignment to form a unitary element that is oblong in plan, the long axis of each individual panel being perpendicular to the long axis of said element, each of said individual panels bearing printed promotional material related to an associated saleable item, at least one of said individual panels bearing a printed redemption coupon, said printed coupon providing for the purchase of the associated saleable item at a predetermined reduction in price, each of said individual panels being connected across said element to an adjacent individual panel by a rectilinear weakened zone, said weakened zones being perpendicular to the long axis of said element, said element being folded by a plurality of parallel over-and-over folds to a member that has the plan size of a single individual panel and a thickness of all of said individual panels combined, said parallel over-and-over folds including a first fold whereby the oblong element is folded to provide pairs of individual panels which are registered in planar parallelism, together with a single endmost panel not in registration with another panel, and with weakened zones being superimposed, and succeeding parallel over-and-over folding of said element at said superimposed weakened zones exclusive of said single endmost panel, terminating with a final parallel over-fold of the element exclusive of said single endmost panel onto said single endmost panel, and means to secure said folder in folded condition against premature opening.

2. The printed coupon folder of claim 1, in which said weakened zone is a crease in said element.

3. The printed coupon folder of claim 1, in which said weakened zone is a score line.

4. The printed coupon folder of claim 1, in which said weakened zone is a line of perforations.

5. The printed coupon folder of claim 1, in which the number of panels is nine and the length of said element along the longer axis is about $46\frac{3}{4}$ inches.

6. The printed coupon folder of claim 1, in which the number of panels is seven and the length of said element along the longer axis is about $36\frac{3}{8}$ inches.

7. The printed coupon folder of claim 1, in which the number of panels is eleven and the length of said element along the longer axis is about $57\frac{1}{4}$ inches.

8. The printed coupon folder of claim 1, in which said printed redemption coupon is substantially the size of a U.S. dollar bill.

* * * * *